US011141751B1

(12) United States Patent
Spellman et al.

(10) Patent No.: US 11,141,751 B1
(45) Date of Patent: Oct. 12, 2021

(54) CHILD RESISTANT SPRAYER

(71) Applicant: Empire-Emco, Inc., Getzville, NY (US)

(72) Inventors: Anne Spellman, Munster, IN (US); Gary M Burns, Lewiston, NY (US)

(73) Assignee: Empire-Emco, Inc., Getzville, NY (US)

( * ) Notice: Subject to any disclaimer, the term of this patent is extended or adjusted under 35 U.S.C. 154(b) by 0 days.

(21) Appl. No.: 16/927,605

(22) Filed: Jul. 13, 2020

Related U.S. Application Data

(60) Provisional application No. 62/873,467, filed on Jul. 12, 2019.

(51) Int. Cl.
*B05B 11/00* (2006.01)

(52) U.S. Cl.
CPC ..... *B05B 11/3056* (2013.01); *B05B 11/3073* (2013.01)

(58) Field of Classification Search
CPC ..... B05B 11/3056; B05B 11/3073
USPC ..... 222/153.1, 153.11–153.14
See application file for complete search history.

(56) References Cited

U.S. PATENT DOCUMENTS

| | | | | |
|---|---|---|---|---|
| 3,729,119 | A | 4/1973 | Sette | |
| 4,369,899 | A * | 1/1983 | Magers | B67D 7/0211 222/153.13 |
| 4,889,262 | A * | 12/1989 | Toms | B05B 11/3059 222/153.13 |
| 4,991,746 | A * | 2/1991 | Schultz | A47K 5/1205 222/153.13 |
| 5,388,730 | A * | 2/1995 | Abbott | B65D 83/205 222/153.13 |
| 6,196,423 | B1 | 3/2001 | Erxleben | |
| 9,718,590 | B2 | 8/2017 | Dejonge | |
| 10,130,964 | B2 * | 11/2018 | Sun | B05B 11/3008 |
| 2012/0292344 | A1 * | 11/2012 | Bertin | B65D 83/205 222/153.13 |
| 2015/0367367 | A1 * | 12/2015 | Lefevre | B65D 50/065 222/153.13 |

* cited by examiner

*Primary Examiner* — Jeremy Carroll
(74) *Attorney, Agent, or Firm* — Phillips Lytle LLP; David L. Principe

(57) ABSTRACT

A child resistant sprayer with an overcap that rotates from a first position where the actuator cannot be engaged by pressing down the overcap to a second position where the overcap is capable of being pressed down into engagement with the actuator to dispense a fluid from a container.

2 Claims, 3 Drawing Sheets

CHILD RESISTANT SPRAYER

TECHNICAL FIELD

The present invention relates generally to the field of sprayers, and more particularly to a sprayer having a child resistant overcap.

BACKGROUND ART

U.S. Pat. No. 3,729,119 discloses a spring biased overcap that includes a control guide or cam groove that receives projections. The movement creates an opening between the outer cap and the actuator so that the user can insert a finger to reach the actuator.

U.S. Pat. No. 9,718,590 discloses an overcap with projections extending inward. The projections fit under a ring on the dispensing container. When a projection is aligned with an opening in the ring and the ring is deflected inward, the overcap can be removed.

U.S. Pat. No. 6,196,423 discloses an overcap that is child resistant and that can only be removed when corresponding protrusions and cutouts are in alignment.

DESCRIPTION OF THE PREFERRED EMBODIMENTS

Figure 4:
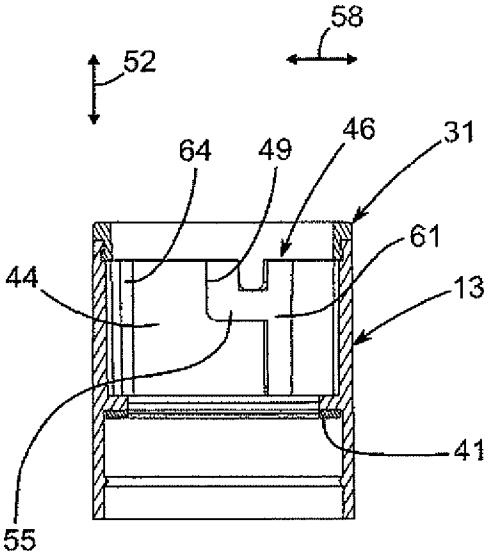
FIG. 4 is a cross-sectional view taken along lines 4-4 of FIG. 3.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, debris, etc.) together with the specification, and are to be considered a portion of the entire written description of this invention. As used in the following description, the terms "horizontal", "vertical", "left", "right", "up" and "down", as well as adjectival and adverbial derivatives thereof, (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or of rotation, as appropriate.

Figure 1:
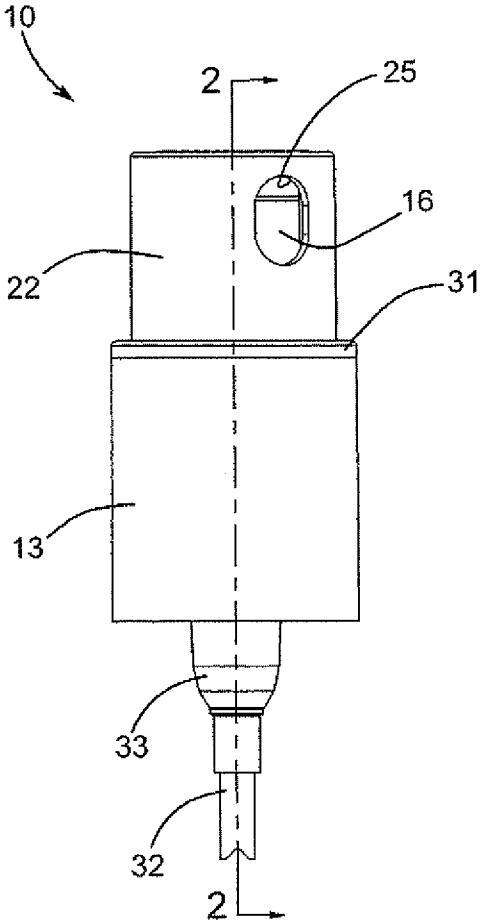
FIG. 1 is a front elevational view of one embodiment of the child resistant sprayer of the present invention in the closed position.
Figure 2:
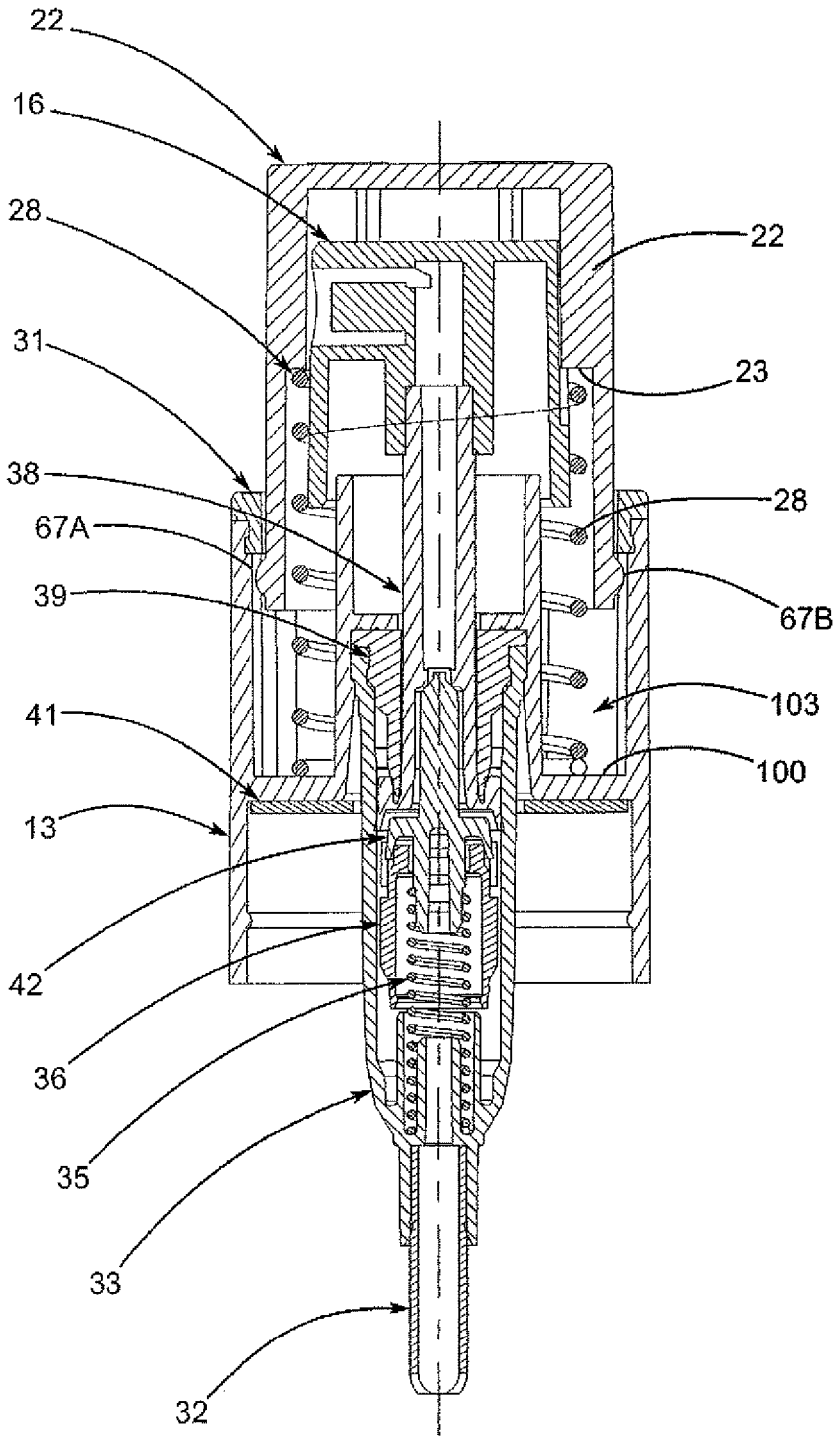
FIG. 2 is a cross-sectional view taken along lines 2-2 of FIG. 1.

Referring now to the drawings, and initially to FIGS. 1 and 2 thereof, this invention includes a push button type sprayer 10 of the type integrated with a closure 13. Closure 13 may be threaded on the inside wall near the bottom end for mating with external threads located at the top of a container (not shown). The sprayer 10 may be provided with a spring-biased actuator 16 that is operatively associated with a dip tube 32 that extends down into the container. The actuator 16 is known to those or ordinary skill in the art and is shown in cross-section in FIG. 2. Because the details of the actuator 16 are known to those of ordinary skill in the art, they will not be described in detail herein.

As shown in FIG. 1, a spring biased overcap 22 surrounds the actuator 16. For most products, a sprayer has a disposable overcap that once removed, allows direct access to the actuator 16 for liquid spray products. The overcap 22 of the present invention is not designed to be removable by the user and protects the actuator 16. The overcap 22, when in a closed position may be pressed downward a short distance but does not activate the actuator 16. The overcap 22 has an opening 25 defined therein. In FIG. 1, the opening 25 is shown in the closed position where it does not align with the spray opening in the actuator 16. In this position, the overcap 22 can be pushed downward toward the actuator 16 for a short distance against the force of a spring 28 (FIG. 2) but the overcap 22 cannot be pushed down far enough to engage with the actuator 16 to dispense a spray.

When the overcap 22 is pressed down against the force of the spring 28 and rotated approximately thirty degrees from the position shown in FIG. 1, the overcap 22 is brought into an open position. In the open position, the overcap 22 can be pushed downward onto the top of the actuator 16. Also, in the open position, the opening 25 on the overcap 22 aligns with the opening in the actuator 16 to allow the sprayer to dispense a spray. Accordingly, as will be described in greater detail herein, when the overcap 22 is in the open position it can be pushed downward onto the actuator 16 such that the overcap 22 and actuator 16 move downward in unison to cause product to be dispensed from the container.

A retaining ring 31 attaches to the closure 13 around the overcap 22 to prevent the overcap 22 from being separated from the closure 13.

In FIG. 2, the actuator 16 is connected to a piston 38 that operates a sliding seal 36 biased by a spring 35. The piston 38 is operatively associated with a lower stem 42 that engages with the sliding seal 36. The dip tube 32 is in fluid communication with a channel formed through the center of the device that extends upward through the center of the piston 38 and the center of the actuator 16. A housing 33 is connected to the dip tube 32. A housing cap 39 is attached to the top of the housing 33. As discussed above, the actuator 16 and the internal components connected between the actuator 16 and the dip tube 32 are known to those of ordinary skill in the art and will not be discussed in detail herein. The interaction between the spring-biased overcap 22, the actuator 16, and the closure 13 will be described in greater detail herein.

As shown in FIG. 2, the overcap 22 has an inward extending surface 23 that forms a shoulder for engaging with the spring 28. The opposite end of the spring 28 rests against a surface 100 formed in an upper chamber 103 of the closure 13. Accordingly, the overcap 22 is spring biased in the upward direction relative to the closure 13. The protrusions 67A and 67B travel up and down in longitudinal slots 64 (FIG. 4) formed in the inner wall 44 of the closure 13. When the overcap 22 is rotated relative to the closure 13 as described in greater detail below, the protrusions 67A and 67B are capable of sliding across and out of one slot 64 and entering the adjacent parallel slot 64. This movement provides a locating feature and a tactile confirmation of the correct position when moving between the open and closed position.

Figure 3:
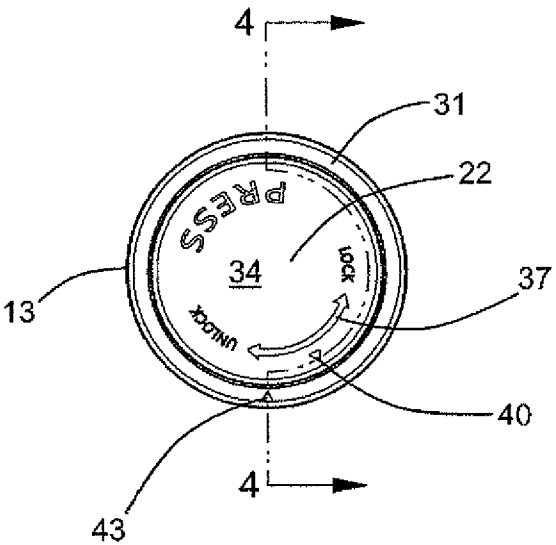
FIG. 3 is top plan view of the child resistant sprayer.

Turning to FIG. 3, the top surface 34 of the overcap 22 is shown. The retaining ring 31 extends between the side of the overcap 22 and the side of the closure 13. As indicated by the instructions on the top surface 34 and the arrow 37, the overcap 22 is pressed downward and rotated to move from the closed to the open position. A first triangle indicating mark 40 is shown on the overcap 22 and a second triangle indicating mark 43 is shown on the retaining ring 31. When the overcap 22 is pressed downward and rotated so that the first and second triangle indicating marks 40, 43 are brought into alignment the overcap 22 is moved from the closed position shown in FIG. 1 into an open position.

Turning to FIG. 4, the inside wall 44 of the closure 13 is shown. A slot 46 is formed in the wall 44. The slot 46 may be formed as a recessed portion either molded or formed by removing material from the inner wall 44 of the closure 13. The slot 46 has a first longitudinal portion 49 extending in the longitudinal direction indicated by arrow 52. A transverse portion 55 intersects with the first longitudinal portion 49 and extends in the transverse direction indicated by arrow 58. The transverse portion 55 extends away from the first longitudinal portion 49 until it intersects with a second longitudinal portion 61.

The second longitudinal portion 61 is longer than the first longitudinal portion 49. The slot 46 is shown on one side of the closure 13. There may be a mirror image slot on the opposite side of the wall 44 inside the closure 13.

The inside wall 44 also has a pair of longitudinal slots 64 on each side.

Figure 6:
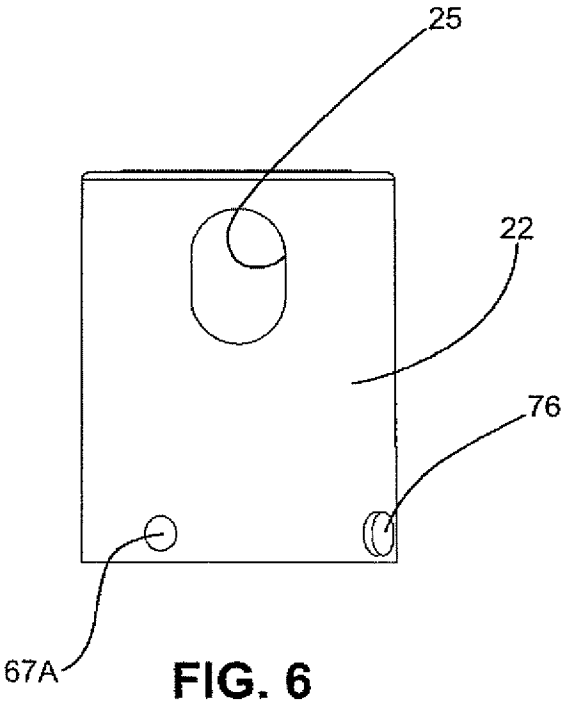
FIG. 6 is a front elevational view of the overcap of the present invention.
Figure 5:
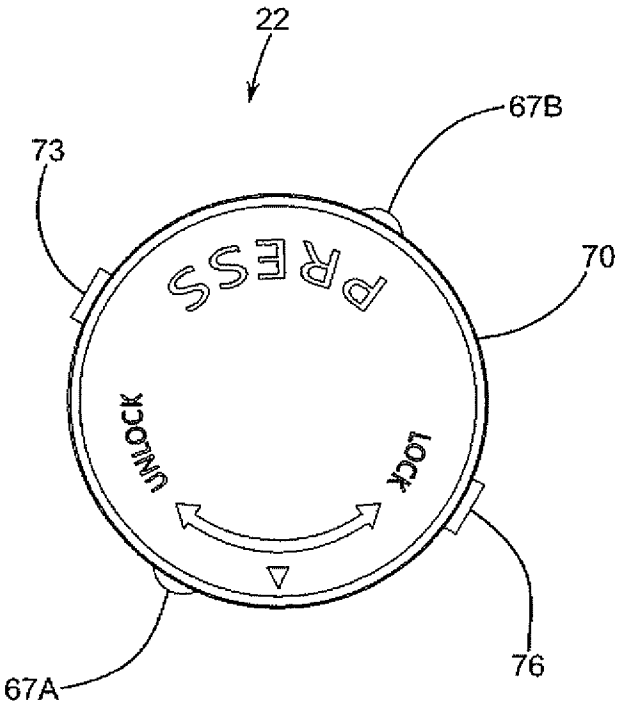
FIG. 5 is a top plan view of the overcap of the present invention.

Turning to FIGS. 5-6, the overcap 22 is provided with a pair of rounded protrusions 67A and 67B on the outside wall 70. The over cap 22 is also provided with a pair of pins 73 and 76. The pins 73 and 76 may be cylindrically shaped or other shapes suitable for traveling inside slot 46. One of the protrusions 67A, 67B and one of the pins 73, 76 may operate on each side of the closure 13.

Returning to FIG. 4, when the overcap 22 is inserted into the closure 13, the protrusion 67A may be disposed in the longitudinal slot 64 and the pin 73 may be disposed in the slot 46. When the protrusion 67A is disposed in longitudinal slot 64, the pin 73 would be disposed in the second longitudinal portion 61 of slot 46. In this position, the opening 25 is disposed in alignment with the opening in the actuator 16 and the overcap 22 can be pressed down against the force of spring 28 (FIG. 2) onto the top surface of the actuator 16 such that the overcap 22 and actuator 16 move in unison downward along the longitudinal, vertical path defined by second longitudinal portion 61. In this open position, due to the length of the second longitudinal portion 61, the overcap 22 can be pressed down into the actuator 16 (against the force of spring 28) causing it to dispense the spray from the container. If the overcap 22 is released the force of spring 28 pushes the overcap 22 upward relative to the closure 13. When the pin 73 aligns with transverse portion 55, the overcap 22 can be rotated such that the pin 73 travels into the transverse portion 55. When the overcap 22 is positioned with pin 73 disposed in the transverse portion 55, the overcap 22 is blocked from being pushed downward by the pin 73 and no spray can be dispensed. If the overcap 22 is rotated farther, the pin 73 enters the first longitudinal portion 49. In this position, when the overcap 22 is released the force of spring 28 causes the pin 73 to move upward into first longitudinal portion 49 where it is out of alignment with the transverse portion 55. This position of the pin 73 inside the upper portion of the first longitudinal portion 49 away from the transverse portion 55 corresponds to the closed position (FIG. 1) where the opening 28 on the overcap 22 is not in alignment with the opening in the sprayer and the overcap 22 can only be moved down a short distance until the pin 73 bottoms out in the first longitudinal portion 49.

In order to go from the closed position to the open position, the overcap 22 is pressed downward against the force of the spring 28 until the pin 73 aligns with the transverse portion 55. Once the pin 73 aligns with the transverse portion 55, the overcap 22 can be rotated such that the pin 73 travels through the transverse portion 55 into the second longitudinal portion 61. Once the pin 73 reaches the second longitudinal portion 61, the overcap 22 can be pressed down into engagement with the actuator 16 to dispense the spray as described above. When the overcap 22 is rotated from the open to the closed position, the protrusions 67A and 67B move between parallel longitudinal slots 64 to provide a locating feature.

The present invention contemplates that many changes and modifications may be made. Therefore, while the presently-preferred form of the child resistant sprayer has been shown and described, and several modifications and alternatives discussed, persons skilled in this art will readily appreciate that various additional changes and modifications may be made without departing from the spirit of the invention.

What is claimed is:

1. A child resistant sprayer, comprising:

a spring-biased overcap;

a spring-biased actuator operatively associated with a dip tube extending into a container, the actuator disposed beneath and substantially surrounded by the overcap;

a closure configured to attach to the container, the closure having an inner wall with one or more slots formed therein;

one or more protrusions disposed on the overcap, the one or more protrusions configured to slide within the one or more slots;

wherein rotation of the overcap from a first position to a second position causes the one or more protrusions to move from the first position where the one or more protrusions is captured in a horizontal slot preventing the overcap from engaging with the actuator to a second position where the one or more protrusions align with a vertical slot in the inner wall of the closure such that the spring-biased overcap can be pressed into engagement with the actuator to dispense a fluid from the container.

2. The sprayer of claim 1 wherein the actuator has an opening for dispensing fluid and the overcap has an opening, the opening in the actuator and the opening in the overcap configured to align when the overcap is rotated into the second position.

* * * * *